United States Patent [19]

Rhodes

[11] 4,406,085

[45] Sep. 27, 1983

[54] MODULAR RADIO CONTROL FOR USE WITH MULTIPLE TOY VEHICLES

[75] Inventor: Tony Rhodes, Torrance, Calif.

[73] Assignee: Mattel, Inc., Hawthorne, Calif.

[21] Appl. No.: 332,709

[22] Filed: Dec. 21, 1981

[51] Int. Cl.[3] ..... A63H 30/04

[52] U.S. Cl. ..... 46/254

[58] Field of Search ..... 46/254, 251, 250, 253, 46/249, 248, 202, 219; 340/825.69, 825.72, 696; 455/66, 352, 346; 180/167

[56] References Cited

U.S. PATENT DOCUMENTS

| | | | |
|---|---|---|---|
| 3,086,465 | 4/1963 | De Montfort | 180/167 X |
| 3,553,885 | 1/1971 | Tazaki | 46/251 |
| 3,659,378 | 5/1972 | Tong | 46/251 |
| 4,124,815 | 11/1978 | Stoschek | 455/66 X |
| 4,171,592 | 10/1979 | Saitoh | 46/254 X |
| 4,221,454 | 9/1980 | Wong | 46/228 X |
| 4,226,292 | 10/1980 | Monte et al. | 46/254 X |

*Primary Examiner*—Mickey Yu

*Attorney, Agent, or Firm*—Reagin & King

[57] ABSTRACT

A modular radio control unit for use with multiple toy vehicles is disclosed. The control unit is in the shape of a vehicle passenger compartment and is designed to plug into a cavity formed in each vehicle. The control unit contains a control circuit including a radio receiver and a motor drive circuit to control two motors mounted in the vehicle and connected to control the motion of the vehicle. The control unit also contains batteries to provide power to the control circuit and to the motors. A set of contacts is provided in the control unit and in each vehicle so that when the control unit is plugged into a vehicle cavity, the output signals from the drive circuits are provided to the motors to effect remote control of the vehicle in response to commands from a transmitter.

8 Claims, 8 Drawing Figures

10
12
13
14
16
18
20
22
24
26
32
33
34
35
36
37
38
39
40
44
52
54
56
58
60
2
6
8

MODULAR RADIO CONTROL FOR USE WITH MULTIPLE TOY VEHICLES

BACKGROUND OF THE INVENTION

This invention relates to radio control units and more particularly, to a modular radio control unit which may be used with many toy vehicles.

A wide variety of radio controlled toy vehicles such as cars, boats and airplanes have been developed over the years. These vehicles typically include a motor, a radio control receiver, and a power source such as batteries. The radio control receiver controls one or more elements of the vehicle in response to commands from a transmitter. The elements controlled are usually those which control the direction and speed of the vehicle.

Most prior art radio controlled vehicles each require a separate receiver and transmitter for their operation. These are among the most expensive components in a radio controlled vehicle. Accordingly, such toys have traditionally been expensive to purchase. Thus, children rarely own more than one such toy and quickly become bored with playing with the single toy.

One way to relieve this problem would be to permit the user to reconfigure the vehicle into a plurality of different shapes as has been done with vehicles which are not radio controlled. For example, U.S. Pat. No. 4,073,086, issued Feb. 14, 1978, to I. Ogawa shows a toy helicopter in which the electric motor and battery compartment may be relocated on the body of the toy to change it from a land vehicle to an amphibious vehicle. U.S. Pat. No. 4,214,402, issued July 29, 1980, to I. Ogawa shows a toy in the form of a rocket with a removable tail section. The tail section includes a battery compartment and control switches, and may be used in conjunction with a second tail section to control the vehicle by means of a cable.

However, due in part to the mechanical and electrical complexity of their construction, prior art designs of radio controlled vehicles cannot be reconfigured by a child. For example, radio controlled vehicles generally have the radio control receiver and motor integrally mounted within the body so that these elements cannot be removed without disassembling the vehicle.

Accordingly, it is an object of the present invention to provide a new and improved radio controlled toy vehicle.

It is another object of the present invention to provide an inexpensive set of radio controlled toy vehicles.

It is yet another object of the present invention to provide a modular radio control unit which may be used interchangeably with many different toy vehicles.

SUMMARY OF THE INVENTION

The foregoing and other objects of the invention are accomplished by a modular radio control unit including a radio control circuit. The control circuit includes a radio receiver and a motor drive circuit. The motor drive circuit at its output terminals provides electrical signals suitable for operating two electric motors. The receiver generates signals to operate the motor drive circuit in response to command signals transmitted from a radio transmitter. The modular control unit also includes power sources in the form of batteries for operating both the control circuit and the two motors. The control unit is designed to look like a passenger compartment of a toy vehicle such as a car or a boat. A set of electrically conductive contacts are provided along the outer surface on one side of the unit, and are connected to the output terminals of the control circuit.

A set of toy vehicles is also provided each of which employs the control unit to provide remote control of the vehicle. One of the toy vehicles is a car having two electric motors mounted therein. Each motor is mechanically connected to drive one of the two rear wheels of the car. The body of the car includes a cavity in the area normally occupied by the passenger compartment. The cavity is designed to accept the control unit in a plug-in fashion. A plurality of electrically conductive contacts are provided along the surface on one side of the cavity and are connected to the electrical input terminals of the motors.

When the control unit is plugged into the cavity in the body of the car, electrical connections are made between the contacts mounted on the control unit and the contacts mounted on the wall of the cavity. Operation of a remote control transmitter may then cause the control unit to provide control signals to the motors to control the speed and direction of the car.

The set also includes a boat. The boat also has electric motors mounted within its hull; each motor is mechanically connected to drive one of two propellers. The body of the boat also includes a cavity in the area normally occupied by the passenger compartment. The cavity is designed to accept the control unit and includes electrical contacts connected to the input terminals of the motors. To provide the toy boat with radio control, the user plugs the modular radio control unit into the cavity provided in the boat. The contacts mounted on the control unit engage the contacts in the cavity of the boat so that the signals generated by the control unit are furnished to the motors to control the speed and direction of the boat. The single modular radio control unit may thus be employed to provide radio control of a plurality of toy vehicles.

Other objects, features, and advantages of the invention will become apparent by reference to the specification taken in conjunction with the drawings in which like elements are referred to by like reference designations throughout the several views.

DESCRIPTION OF THE PREFERRED EMBODIMENT

Figures 1, 2:
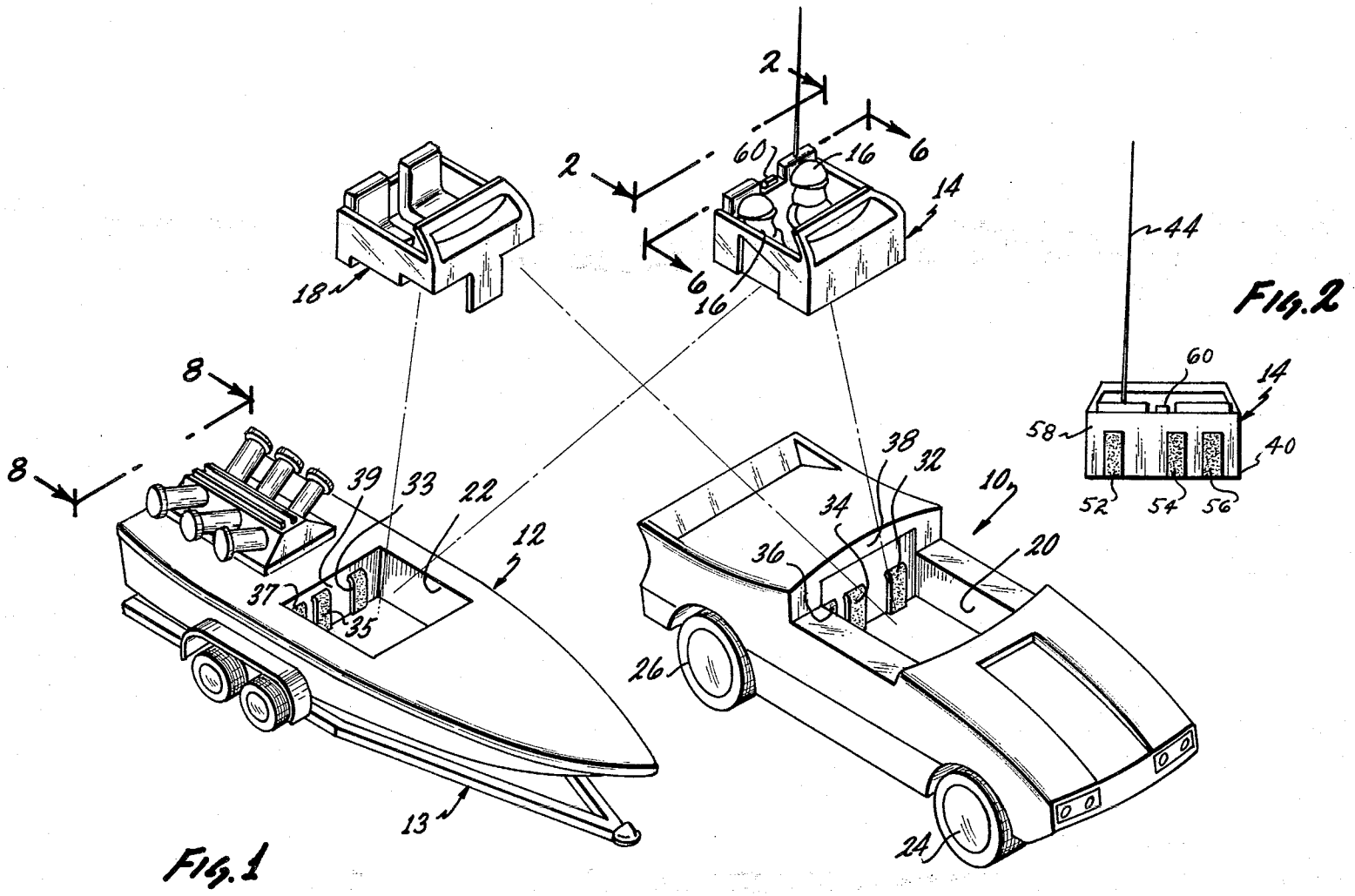
FIG. 1 is an exploded perspective view of a set of toy vehicles including a toy boat, a toy car, a modular radio control unit, and a seat module as constructed in accordance with the present invention.
FIG. 2 is another perspective view of the modular radio control unit of the present invention as viewed from the line 2—2 of FIG. 1 which shows the electrical contacts mounted on the rear surface thereof.

FIG. 1 shows a toy vehicle set constructed in accordance with the present invention. The set includes a vehicle in the shape of a car 10 and a vehicle in the shape of a boat 12 (shown mounted on a boat trailer 13). The bodies of both the car 10 and the boat 12 may be formed of moldable plastic material such as high impact styrene. The set also includes a modular radio control unit 14 shaped like a vehicle passenger compartment in which are seated two passengers 16 and includes a seat module 18 shaped like an empty vehicle passenger compartment. The unit 14 and the module 18 are formed to have similar dimensions of length and width.

The car 10 and the boat 12 have cavities 20 and 22, respectively, where the passenger compartments would normally be. The cavities 20 and 22 have identical dimensions of length and width and are sized so that either the unit 14 or the module 18 may be plugged into either cavity 20 or 22.

Figure 3:
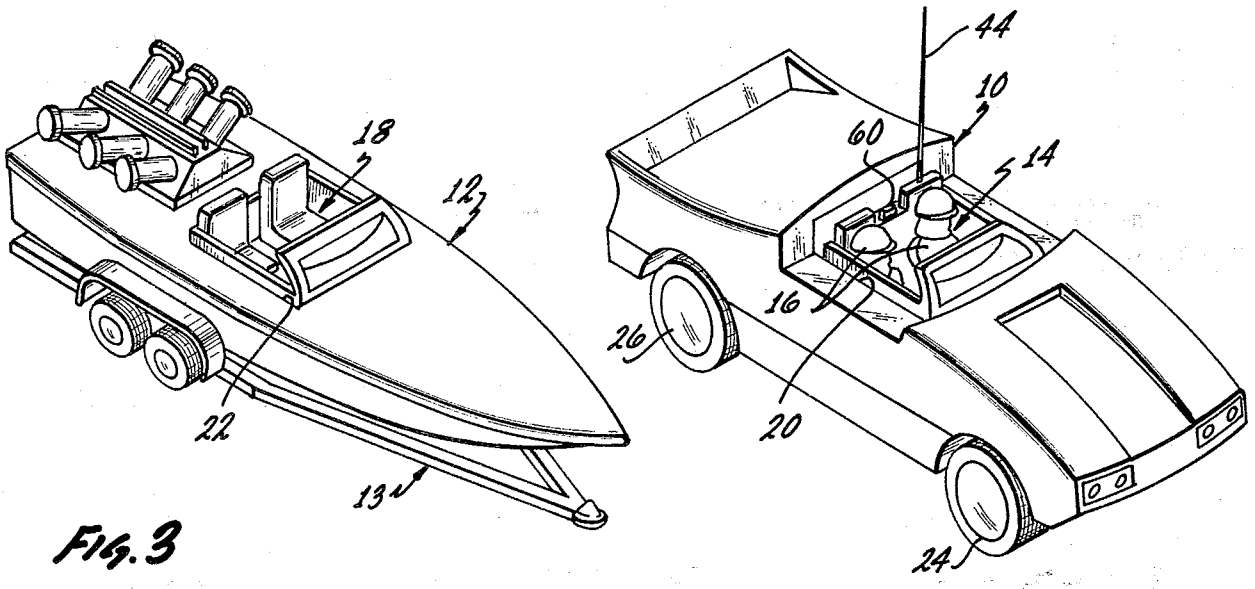
FIG. 3 is a perspective view of the toy car and the toy boat of the present invention showing the toy car with the radio control unit installed therein and the toy boat with the seat module installed therein.
Figure 4:
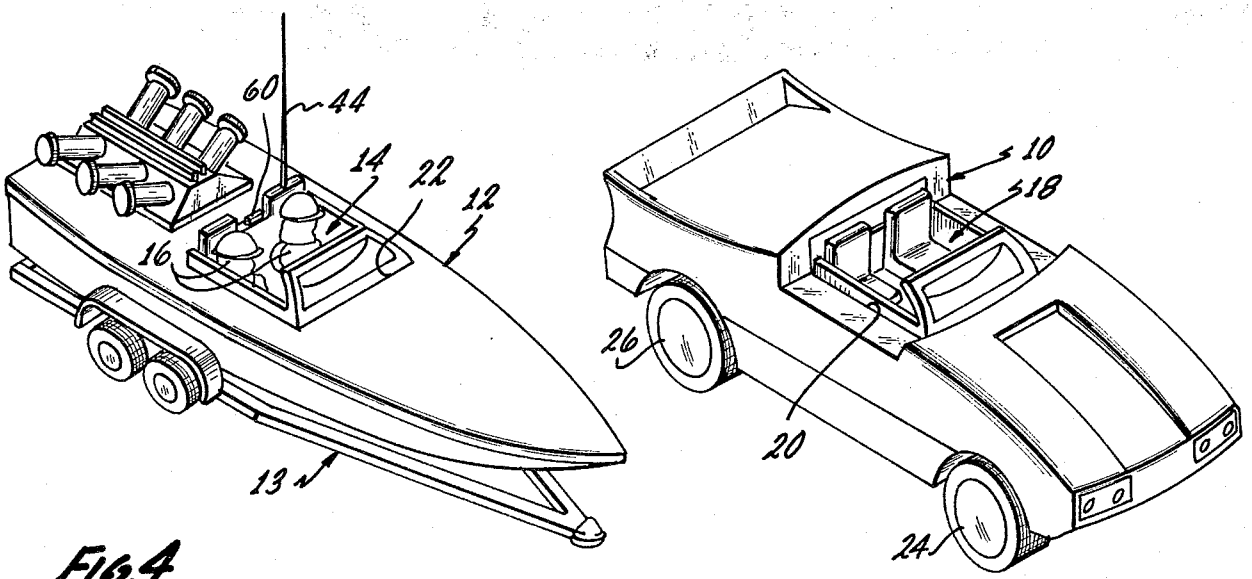
FIG. 4 is a perspective view of the toy car and the toy boat of the present invention showing the toy car with the seat module installed therein and the toy boat with the radio control module installed therein.

FIG. 3 shows the car 10 with the control unit 14 installed in the cavity 20 and the boat 12 with the seat module 18 installed in the cavity 22. FIG. 4 shows the car 10 with the seat module 18 installed in the cavity 20 and the boat 12 with the control unit 14 installed in the cavity 22.

The car 10 also has rotatably mounted front and rear wheels 24 and 26, respectively. From the schematic block diagram of the car 10 shown in FIG. 5, it can be seen that each of the rear wheels 26 is coupled to one of two DC motors 28 and 30. The motors 28 and 30 are mounted within the rear section of the body of the car 10 in a manner well known to those skilled in the art. A typical motor for use in this application is type number RE 260, supplied by Mabuchi Motor Co., Japan.

Figure 5:
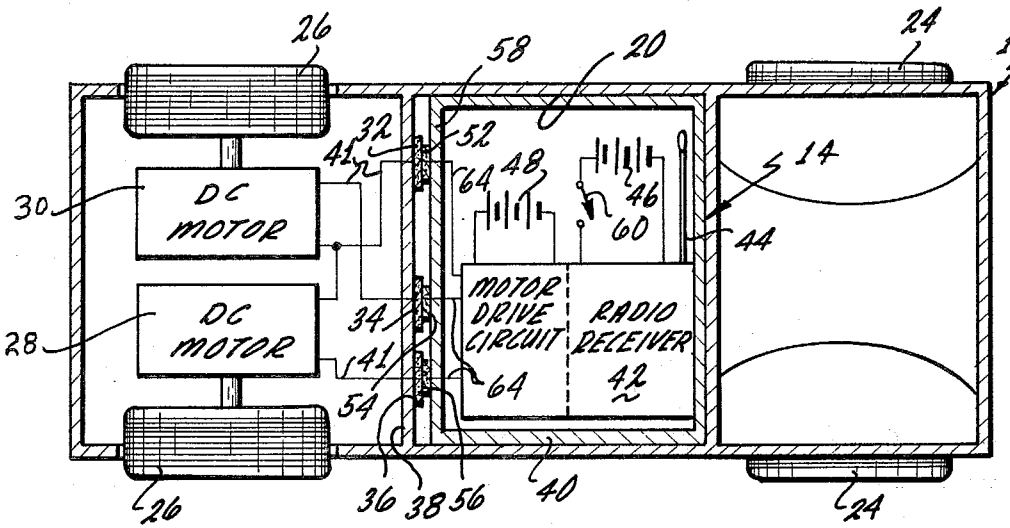
FIG. 5 is a schematic block diagram of the electrical circuit of the toy car of the present invention showing the interconnections between the car and the modular radio control unit.

FIGS. 1 and 5 each show three parallel, spaced-apart electrically conductive terminals 32, 34, and 36 mounted along a rear wall 38 of the cavity 20 of the car 10. Conductors 41 connect between the terminals 32, 34, and 36 and the motors 28 and 30 as shown in FIG. 5 so that the application of a first electrical signal between the terminals 32 and 34 causes rotation of the motor 30 and the application of a second electrical signal between the terminals 32 and 36 causes rotation of the motor 28.

As is well known to those skilled in the art, the dual motor configuration described above permits the control of both the speed and direction of the car 10 by means of first and second electrical signals. For example, by providing first and second electrical signals of the same magnitude, the wheels 26 are driven at the same speed and the car 10 proceeds along a straight line at a speed dependent on the magnitude of the signals. Varying the magnitude of one of the signals relative to the other signal causes a change in the relative speed of the motors 28 and 30 which in turn causes the car 10 to turn one way or the other. Reversing the polarity of the electrical signals causes the car 10 to reverse direction.

Figure 7:
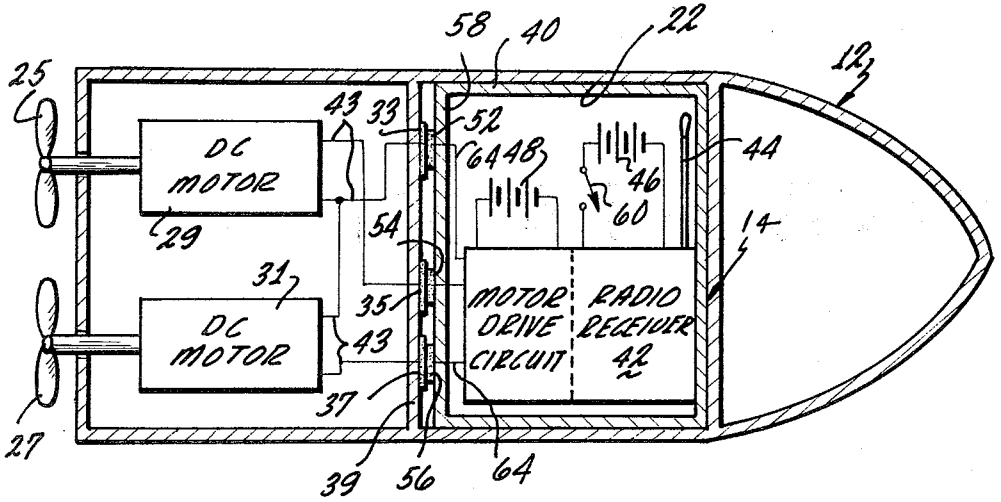
FIG. 7 is a schematic block diagram of the electrical circuit of the toy boat of the present invention showing the interconnections between the boat and the modular radio control unit.
Figure 8:
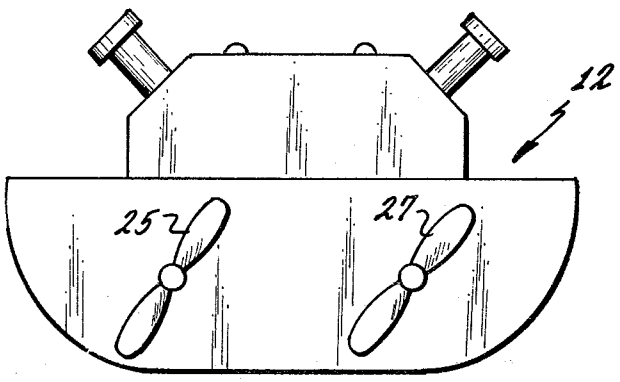
FIG. 8 is a rear view of the toy boat of the present invention as viewed from the line 8—8 of FIG. 1.

In a similar fashion, the boat 12 also includes three parallel, spaced-apart electrically conductive contacts 33, 35, and 37 mounted along a rear wall 39 of the cavity 22. FIG. 7 shows that the terminals 33, 35, and 37 are electrically connected to two DC motors 29 and 31 by conductors 43. The motors 29 and 31 may be similar to the motors 28 and 30 of the car 10; the connections of the conductors 43 are made in an identical fashion to the connections of the conductors 41 of the car 10. The motors 29 and 31 are mounted within the rear section of the boat 12. Each motor 29 and 30 is mechanically connected to drive one of two propellers 25 and 27, respectively, which are mounted to project through the rear wall of the boat 12 as shown in FIG. 8.

From the above description, it will be apparent that the application of a first control signal between the terminals 33 and 35 and the application of a second control signal between the terminals 33 and 37 will control, respectively, the operation of the propellers 25 and 27 in a manner analogous to the control of the wheels 26 of the car 10 to effect control of both the speed and the direction of the boat 12.

Figure 6:
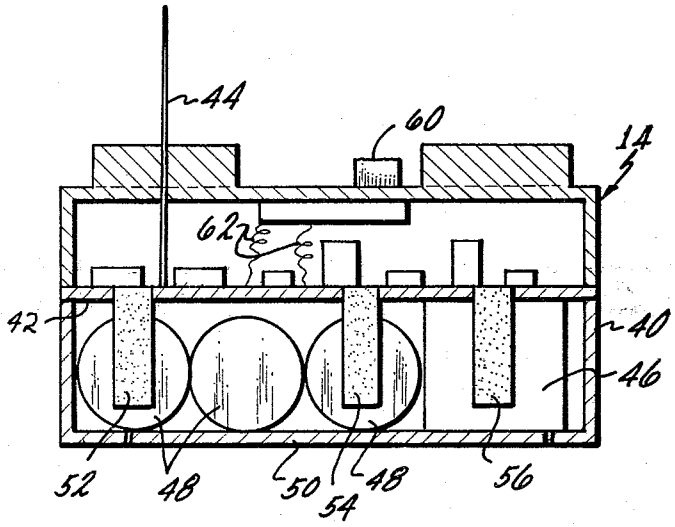
FIG. 6 is a cross-sectional view of the modular radio control unit of the present invention taken along the line 6—6 of FIG. 1.

The details of the construction of the modular remote control unit 14 will now be described with reference to FIGS. 2, 5, and 6. The control unit 14 includes a hollow, plastic housing 40 within which is mounted a radio control circuit 42. The circuit 42 includes a radio receiver and a motor drive circuit. The motor drive circuit provides the first and second electrical signals to control two motors. The receiver generates signals to operate the motor drive circuit in response to radio signals transmitted to the receiver circuit from a remotely controlled transmitter (not shown). The entire circuit 42 is constructed on a printed circuit board which is mounted within the housing 40 as shown in FIG. 6. An antenna 44 is also provided which projects through the top of the housing 40. A typical radio control circuit for use in the present invention is similar to that described in U.S. Pat. No. 4,080,602, entitled "Wireless Control System for a Travelling Toy using a Single Transmitting and Receiving Channel", issued on Mar. 21, 1978, to T. Hattori, et al.

Power to operate the radio control circuit is furnished by a battery 46 (such as a nine volt transistor battery) which is mounted within the housing 40. Also mounted within the housing 40 are batteries 48 which furnish power to operate two motors in the manner described above. A removable door 50 is provided in the bottom of the housing 40 to permit access to install or remove the batteries 46 and 48. The batteries 46 and 48 may be connected to the various portions of the circuit 42 using battery clips in a manner well known to those skilled in the art.

Three parallel, spaced-apart, electrically-conductive terminals 52, 54, and 56 are provided as part of the control unit 14 and are mounted along the outside surface of a rear wall 58 of the housing 40 shown in FIG. 2. The terminals 52, 54, and 56 may be formed of material such as brass or beryllium-copper and are connected to the control circuit 52 through openings in the wall 58. An electrical switch 60 is also provided as part of the control unit 14 and is mounted through the upper wall of the housing 40 as shown in FIGS. 2 and 6. The switch 60 is connected to the control circuit using conductors 62.

The electrical interconnections between the various elements of the control unit 14 are shown in FIG. 5. The switch 60 serves to connect the battery 46 to provide power to operate the control circuit 42. The output terminals of the motor drive portion of the circuit 42 are connected to the terminals 52, 54, and 56 using conductors 64. The battery 48 is connected to the circuit 42 and serves to furnish power to operate two motors in the manner described below.

The operation of the toy vehicle set described above is as follows. To effect remote control of the car 10, the user installs the modular radio control unit 14 into the cavity 20 of the car 10 as shown in FIG. 3. (It is assumed that the user has previously installed the proper batteries 46 and 48 into the housing 40 of the unit 14 by means of the door 50). With the unit 14 thus installed, the three contacts 52, 54, and 56 on the unit 14 mate, respectively, with the three contacts 32, 34, and 36 mounted within the cavity 20 of the car 10, as shown in FIG. 5. The contacts 32, 34, and 36 may be constructed of a resilient material such as beryllium-copper and are shaped to form cantilever springs in a manner well known to those skilled in the art. The spring action of the contacts 32, 34, and 36 serves to provide positive electrical contact to the contacts 52, 54, and 56 and further serves to hold the module 14 within the cavity 20.

With the unit 14 installed in the car 10, the output signals from the motor drive portion of the circuit 42 within the control unit 14 are coupled to the motors 28 and 30 as shown in FIG. 5. When the switch 60 is closed to furnish power to the circuit 42, it responds to commands transmitted by the user from a remotely controlled radio transmitter. In response to the transmitted commands, the motor drive portion of the circuit 42 (in conjunction with the battery 48) provides the first and second electrical signals to the motors 28 and 30 to effect remote control of the speed and direction of the car 10.

To effect remote control of the boat 12, the user plugs the control unit 14 from the car 10 into the cavity 22 of the boat 12 as shown in FIG. 4. In an analogous manner to that described above for the car 10, the electrical contacts 52, 54, and 56 on the unit 14 mate with the contacts 33, 35, and 36, respectively, mounted within the cavity 22, as shown in FIG. 7. The contacts 33, 35, and 36 may be formed of the same material and in an identical fashion to the contacts 32, 34, and 36 and serve, along with the conductors 43, to furnish the output signals from the circuit 42 to the motors 29 and 31. Accordingly, the speed and the direction of the boat 12 may now be remotely controlled by the unit 14 in response to commands transmitted from a remote radio transmitter.

The seat module 18 shown in FIG. 1 is a molded plastic part shaped in the form of an empty passenger compartment and occupies the same area as the control unit 14. Thus, when the user installs the unit 14 in the car 10 to remotely control it, he may install the seat module 18 into the cavity 22 of the boat 12 as shown in FIG. 3. The module 18 serves to conceal from view the cavity 22 in the boat 12, and adds to the realism of the toy vehicle by simulating an empty passenger compartment for the vehicle which is not being remotely controlled. In similar fashion, the passengers 16 provided as part of the control unit 14 also add to the realism of the toy vehicle by simulating an occupied passenger compartment for the vehicle which is being remotely controlled. When the user installs the unit 14 in the boat 12 to remotely control it, he may switch the seat module to the cavity 20 of the car 10 as shown in FIG. 4.

The boat trailer 13 is provided so that the boat 12 may be towed behind the car 10 (which is equipped with a trailer hitch, not shown) when the car 10 is being remotely controlled.

The modular radio control unit 14 of the present invention provides a variety of advantages over the prior art designs of radio controlled vehicles. One advantage is that only a single radio control circuit 42 is required to control a plurality of vehicles. Further, only one set of batteries is required to provide power both to the control circuit and to the motors of a plurality of vehicles. All of the above advantages are achieved by a single control unit 14 which may be easily installed in a vehicle by a child without requiring complex disassembly of components. The present invention also provides great economies of manufacture, resulting in the availability of a multitude of low cost remotely-controlled toys.

Although the invention described above illustrates a toy car and a toy boat for use with the modular radio control unit, it will be apparent to those skilled in the art that the invention is equally applicable to a variety of other toy vehicles such as airplanes, rockets, trains, and the like. Further, although the preferred embodiment of the invention contemplates the use of two motors to effect the motion of the vehicle, it will be apparent to those skilled in the art that the invention is equally applicable to other types of remote control configurations such as those which employ servo systems and escapement mechanisms.

Thus, while the invention is disclosed and a particular embodiment is described in detail, it is not intended that the invention be limited solely to this embodiment. Many modifications will occur to those skilled in the art which are within the spirit and scope of the invention. It is thus intended that the invention be limited in scope only by the appended claims.

What is claimed is:

1. A toy vehicle set comprising:

a first toy vehicle including a body having an open cavity formed therein where the cavity opening is in the upper surface of the vehicle body;

electrically operated control means mounted within the body for controlling the motion of the first vehicle in response to a control signal;

a first set of electrical contacts mounted within the cavity, and means for electrically connecting the first set of contacts to the control means;

a modular radio control unit including a body shaped to removably plug into the cavity to secure the control unit to the vehicle body without the need to disassemble the vehicle body, and having an antenna which projects from the control unit body, whereby the antenna extends above the upper surface of the vehicle body when the control unit is plugged into the cavity;

a control circuit mounted within the control unit, including a radio receiver coupled to the antenna and responsive to signals from a remotely controlled radio transmitter and a drive circuit responsive to the radio receiver to provide the control signal at an output terminal to operate the control means;

a second set of electrical contacts mounted to the control unit and positioned so that the second set of contacts is caused to mate with the first set of contacts when the control unit is plugged into the cavity;

means for electrically connecting the second set of contacts to the output terminal of the drive circuit;

means for removably mounting a power source within the control unit body; and means within the control unit body for connecting the power source to provide power to the control circuit, whereby when the control unit is placed within the cavity the control signal from the drive circuit is provided to the control means through the first and second sets of contacts so that the motion of the first vehicle may be remotely controlled in response to signals from the radio transmitter.

2. The apparatus of claim 1 in which the cavity is formed in that part of the vehicle body normally occupied by a passenger compartment, and in which the body of the control unit is further shaped in the form of the passenger compartment, including figures representing passengers.

3. The apparatus of claim 1 in which the means for removably mounting a power source includes means for mounting a first battery to provide power to operate the control circuit and means for mounting a second battery to provide power to operate the control means.

4. The apparatus of claim 1 in which the means for connecting the power source to provide power to the control circuit includes a switch mounted to the control unit and means for connecting the switch to control the application of power to the control circuit.

5. The apparatus of claim 1 in which the control means includes two electric motors.

6. The apparatus of claim 1 in which the first set of contacts are each formed of a resilient material shaped to act as a cantilevered spring, and which are mounted in a parallel, spaced-apart relationship along a wall of the cavity so that when the control unit is installed in the cavity the first set of contacts acts to retain the control unit in the cavity.

7. The apparatus of claim 1 further including a second toy vehicle including a second body having a second cavity formed therein which is shaped to removably receive the radio control unit therein;

second electrically operated control means mounted within the second body for controlling the motion of the second vehicle in response to the control signal;

a third set of electrical contacts mounted within the second cavity and positioned to mate with the second set of contacts when the control unit is placed within the second cavity; and means for connecting the third set of contacts to the second control means, whereby when the control unit is placed within the second cavity the control signal from the drive circuit is provided to the second control means through the second and third sets of contacts so that the motion of the second vehicle may be remotely controlled in response to signals from the radio transmitter.

8. A toy vehicle set comprising:

a first toy vehicle including a body having a cavity formed therein;

electrically operated control means mounted within the body for controlling the motion of the first vehicle in response to a control signal;

a first set of electrical contacts mounted within the cavity, and means for electrically connecting the first set of contacts to the control means;

a modular radio control unit including a body shaped to removably fit within the cavity;

a control circuit mounted within the control unit, including a radio receiver responsive to signals from a remotely controlled radio transmitter and a drive circuit responsive to the radio receiver to provide the control signal at an output terminal to operate the control means;

a second set of electrical contacts mounted to the control unit and positioned so that the second set of contacts mates with the first set of contracts when the control unit is placed within the cavity;

means for electrically connecting the second set of contacts to the output terminal of the drive circuit;

means for removably mounting a power source within the control unit body;

means within the control unit body for connecting the power source to provide power to the control circuit, whereby when the control unit is placed within the cavity the control signal from the drive circuit is provided to the control means through the first and second sets of contacts so that the motion of the first vehicle may be remotely controlled in response to signals from the radio transmitter, a second toy vehicle including a second body having a second cavity formed therein which is shaped to removably receive the radio control unit therein;

second electrically operated control means mounted within the second body for controlling the motion of the second vehicle in response to the control signal;

a third set of electrical contacts mounted within the second cavity and positioned to mate with the second set of contacts when the control unit is placed within the second cavity;

means for connecting the third set of contacts to the second control means, whereby when the control unit is placed within the second cavity the control signal from the drive circuit is provided to the second control means through the second and third sets of contacts so that the motion of the second vehicle may be remotely controlled in response to signals from the radio transmitter, and a seat module shaped to removably fit within the first and second cavities and further shaped in the form of an unoccupied passenger compartment, whereby the seat module may be placed within either the first or second cavity to conceal that cavity and to simulate an unoccupied vehicle.

* * * * *